United States Patent [19]

Poage et al.

[11] 4,133,476

[45] Jan. 9, 1979

[54] VISUAL DISPLAY CALCULATOR

[75] Inventors: Roy L. Poage; Michael A. Jewell, both of Sycamore, Ill.

[73] Assignee: DeKalb Ag Research, Inc., Sycamore, Ill.

[21] Appl. No.: 859,021

[22] Filed: Dec. 9, 1977

[51] Int. Cl.[2] ..... G06C 3/00

[52] U.S. Cl. ..... 235/85 FC; 235/88 RC

[58] Field of Search ..... 235/85 FC, 78 RC, 88 RC, 235/84; 40/107, 111

[56] References Cited

U.S. PATENT DOCUMENTS

| | | | |
|---|---|---|---|
| 1,495,805 | 5/1924 | Rooney | 235/85 FC |
| 2,615,631 | 10/1952 | Sorrels | 235/85 FC |
| 3,278,118 | 10/1966 | Klein, Jr. | 235/85 FC |
| 3,486,691 | 12/1969 | Rodriguez | 235/85 FC |
| 3,570,448 | 3/1971 | Gates | 235/85 FC |

*Primary Examiner*—Stephen J. Tomsky
*Attorney, Agent, or Firm*—Kinzer, Plyer, Dorn & McEachran

[57] ABSTRACT

A calculator for use in planning the orderly production of swine throughout a calendar year. The calculator includes a base and a disc rotatably mounted on the base. A circular scale is formed on the base around the outer edge of the disc. This circular scale has 365 equally spaced marks numbered in sequence around the scale. A second circular scale is formed on the outer edges of the disc and it has indicia indicating the months of the year with each month having indicia indicating the days of the month. The sequence of the indicia on the disc scale run in the opposite direction of rotation to the sequence of the indicia on the base scale. An alignment indicator is provided overlying the scales and aligned with the indicia number 1 on the base scale. A series of spaced, circumferentially extending bands are superimposed on the indicia of the base scale. The location of each band on the base scale and its arcuate extent correspond to a time period in the breeding and growing cycle of swine which is significant for production purposes. A series of trapezoidal shaped films are releasably adhereable to the disc. These are adapted to be positioned with the edges of the films located adjacent the peripheral edge of the disc and the tips of the films extending towards the center of the disc. Each trapezoidal shaped film has a larger end edge with a length equal to the spacing of seven indicia of the scale on the disc. A transparent portion is located at the larger end edge of the trapezoidal film with the remainder of the film subdivided into information receiving segments.

3 Claims, 2 Drawing Figures fig.1.
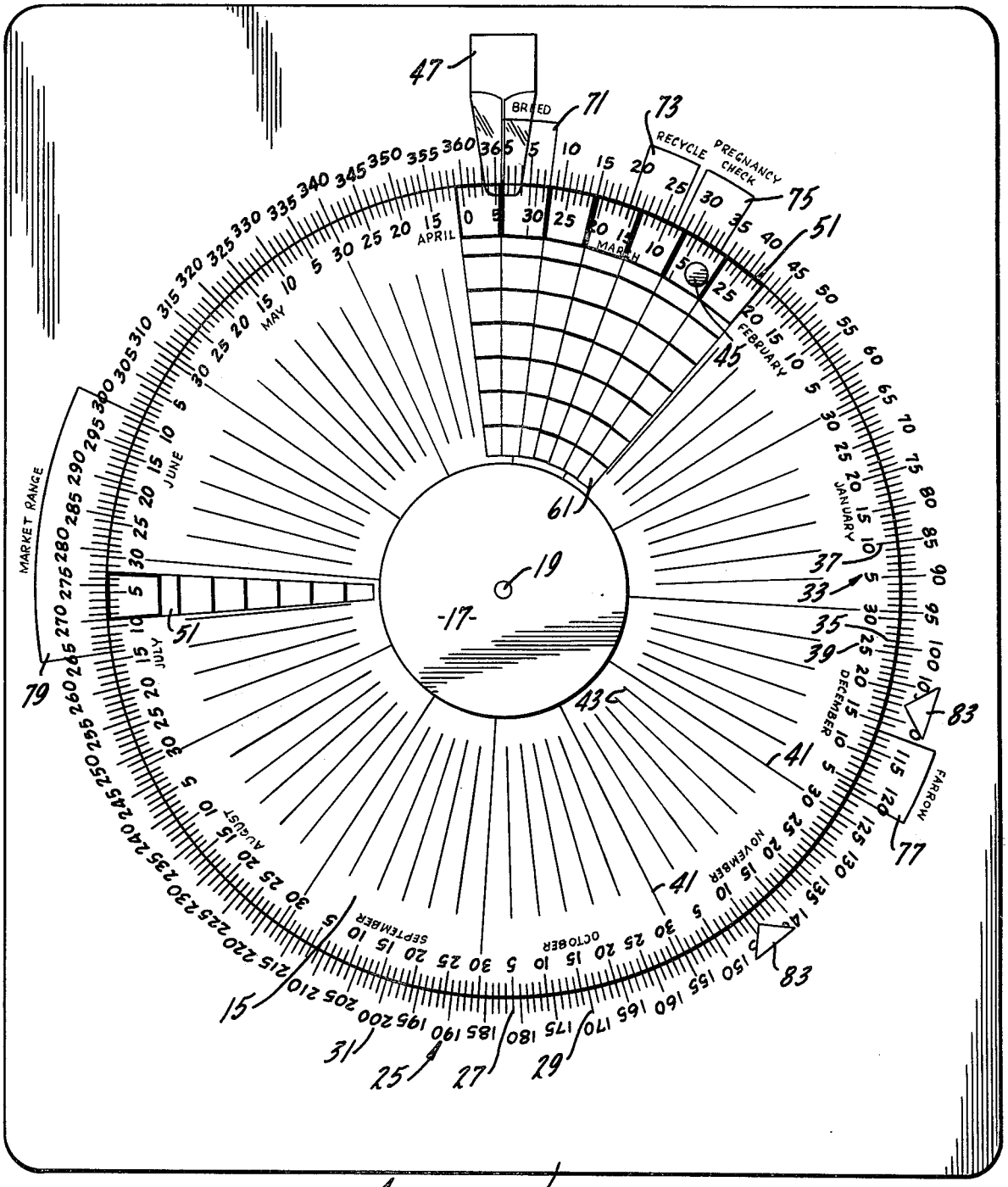
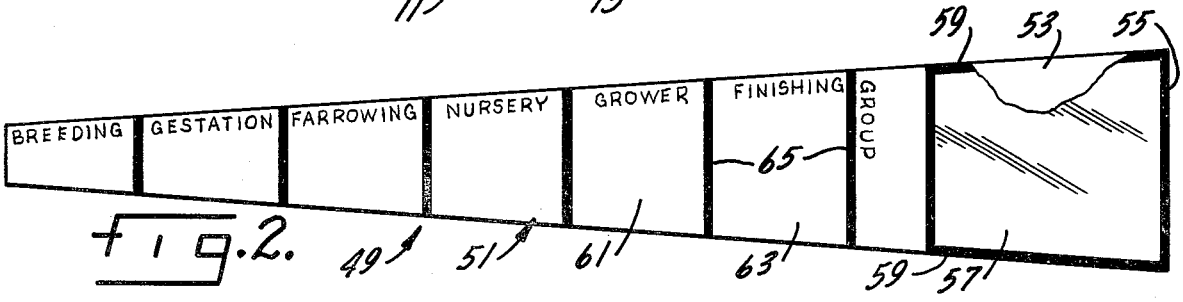
fig.2.

VISUAL DISPLAY CALCULATOR

BACKGROUND AND SUMMARY OF THE INVENTION

The breeding and raising of pigs in confinement is becoming more wide spread and important in the agricultural industry. The breeding and raising of pigs in confinement requires relatively expensive structures which by their nature are of limited capacity. In order to efficiently utilize these structures, the pigs must be bred in relatively uniform numbers throughout the year. The scheduling of pig production on a uniform basis has presented problems to the pig raiser.

SUMMARY OF THE INVENTION

This invention is concerned with a visual display mechanism which will assist a pig raiser in planning the breeding and production of pigs at a relatively uniform rate throughout the year.

Another object of this invention is a visual display mechanism which will assist a pig raiser in planning the production of pigs on a relatively uniform basis throughout the year.

An object of this invention is a visual display mechanism which enables the pig raiser to breed, raise and market pigs in relatively uniform numbers throughout the year.

Another object of this invention is a visual display mechanism which enables the pig raiser to determine at a glance when to breed, farrow and market each group of pigs to maintain production on a uniform basis throughout the year.

Another object is a visual display calculator which enables a pig raiser to determine at a glance the progress in the gestation period of a group of sows bred during the same time period.

Other objects may be found in the following specification, claims and drawings.

BRIEF DESCRIPTION OF THE DRAWINGS

The invention is illustrated more or less diagrammatically in the following drawings wherein:

FIG. 1 is a plan view of a calculator embodying the novel features of this invention; and FIG. 2 is an enlarged plan view of an information receiving sticker which is attached to the calculator.

DESCRIPTION OF THE PREFERRED EMBODIMENT

The drawings depict a visual display mechanism or calculator constructed in accordance with the teachings of this invention which enables a pig raiser to produce pigs on a generally uniform basis throughout the year. The uniform production of pigs became important when pigs began to be confined during breeding, the gestation and fattening for market. A uniform rate of production of pigs is necessary to avoid alternately overcrowding and under utilizing the various structures used to house the pigs during raising in confinement.

The visual display calculator of this invention is based on the natural gestation period of the sow and growth characteristics of the piglets. In a uniform, year around production plan, the sows are divided into twenty-two groups of approximately equal numbers. One group of sows is started each week in the breeding cycle so that the first group will be ready for rebreeding after the twenty-first group has started the breeding cycle. This schedule is based on a weaning period for the piglets of 144 days from the start of the sow's breeding cycle.

The visual display calculator 11 of this invention enables the pig breeder to easily and efficiently plan an orderly and uniform production. It consists of a generally rectangular base 13 which may be formed from a sheet of fiber board, particle board or similar material cut to a convenient size. A disc 15 of the same material is rotatably mounted on the base. A third and smaller disc 17 may be mounted outwardly of the disc 15. This smaller disc 17 may be used to display a trademark or descriptive title of the calculator.

The discs are rotatably mounted on the base 13 by a connection 19 which may consist of a nut and a shoulder bolt. Washers may be provided as needed. Spacers may be installed on the bolt at the rear of the disc 15 to maintain the spacing of the disc from the base 13. The spacers may be small pieces of an adhesive coated plastic.

A circular scale 25 is marked on the base 13 just outwardly of the outer periphery of the disc 15. The circular scale 25 is made up of 365 individual lines 27 which are equally spaced around the circle. Every fifth line has a portion 29 which extends outwardly beyond the other lines and is marked with a numeral 31. The line 27 having an extending portion 29 and which is located at the top center of the circle is indicated by the numeral 365. The first line 27 having an extending portion 29 located in a clockwise direction from the line indicated by the numeral 365 is marked by the numeral 5 so that the numerals increase on this scale in a clockwise direction when facing the calculator. This scale indicates the days elapsed from the start of the breeding cycle for the sows in a designated group.

A similar circular scale 33 is formed on the outer periphery of the disc 15. This scale consists of 365 lines 35 equally spaced apart around a circle. Each fifth line has a portion 37 extending inwardly of the lines 35 and is marked with a numeral 39. The numerals 39 correspond to the days of the month because the scale 33 is also divided into months by radially extending solid lines 41. The names of the months are applied to the disc between the corresponding lines 41. The circular scale 33 runs from January 1 to December 31 in counterclockwise direction as viewed when facing the calculator. Thus, the scales 25 and 33 increase in value in opposite directions of rotation. Additionally radially extending lines 43 are aligned with the lines having the extending portions 37. A knob 45 is mounted on the disc 15 to facilitate rotation thereof.

Releasably adhereable trapezoidal shaped information receiving films are formed as parts of members 49 for attachment to the face of the disc 15. Each member 49 includes a plastic film 51 having a pressure sensitive adhesive on one surface. A backing sheet 53 having a release agent is adhered to the pressure sensitive adhesive. In use, the backing sheet is removed from the member 49 to permit the plastic film 51 to be adhered to the disc 15.

The trapezoidal shaped plastic film 51 has a width at its larger end edge 55 equal in extent to the spacing between seven lines 35. Thus, the larger end edge extends over a span equal to a week on the circular scale 35. The portion 57 of the plastic film adjacent the end edge 55 is transparent and is enclosed with a dark border 59 so that the lines 35 and 37, numerals 39 and the names of the months are visible when the plastic film 51 is applied to the disc 15.

The remaining portion of the trapezoidal shaped plastic film 51 is overprinted in a color which is preferably opaque. At least six distinctive colors are used on various plastic films to provide six groups of plastic films 51. The colored portion 61 of each plastic film is divided into trapezoidal segments 63 by lines 65 which may be applied by printing or otherwise to the film. Each trapezoidal segments 63 is labeled to identify a significant operation or event during the breeding and raising of pigs for market. For example, the segments may be respectively labeled "Group", "Breeding", "Gestation", "Farrowing", "Nursery", "Grower" and "Finishing". Each trapezoidal segment also contains unobstructed space to receive information applied thereto.

A series of spaced, circumferentially extending bands are superimposed on the circular scale 25. The bands are imprinted in color on the base 13 so as not to obscure the lines 27 and numerals 31 of the scale 25. The bands indicate the location and duration of time periods which are significant in the brreding and growing cycle of the pigs.

Band 71 indicates the period during which each group of sows are bred. This period extends from the first day to the eighth day indicated on the scale 25. It is identified by the word "BREED". Band 73 indicates the time period in which the sows that did not become pregnant during the breeding period will come back to "HEAT". This period extends from the 20th to the 27th day indicated on the scale 25. This band is identified by the word "RECYCLE".

Band 75 indicates the time period in which the sows of a group should be checked to determine if they are pregnant. This period extends from the 28th day to the 35th day of the sow's breeding cycle as indicated on the scale 25. It is identified by the words "PREGNANCY CHECK".

Band 77 indicates the time period in which the sows will farrow. This time period extends from the 113th day to the 122nd day on the scale 25. This band is identified by the word "FARROW".

Band 79 indicates the time period in which the pigs will be ready to be marketed. This time period extends from the 265th day to the 300th day on the scale 25. It is identified by the words "MARKET RANGE".

Triangular shaped stickers 83 which can be attached to the base 13 to indicate a particular day on the scale 25 are also provided. These stickers are used to indicate significant times in the breeding and growing cycle of swine which can be varied at the discretion of the grower. These stickers may be preprinted with designations such as "TO FARROWING", "WEAN", "TO GROWER" or "TO FINISHING". Other stickers may be adapted to receive other identifying notations.

The use, operation and function of this invention are as follows:

The visual display calculator 11 of this invention assists the pig raiser in planning an orderly and uniform production of pigs on a year round basis. In establishing such a plan, a weaning period for the piglets must be determined. The schedule to be described hereinafter is based on a weaning period of 144 days from the start of the sow's breeding cycle. In implementing such a plan, the sows owned by the raiser are divided into 21 groups of approximately equal numbers. One group of sows is started each week in the breeding cycle so that the first group will be ready for re-breeding after the twenty-first group has started the breeding cycle. This is based on the characteristics of sows that 88% will come back into heat in three to seven days after weaning of their piglets.

Assuming that the pig raiser wishes to start his planned production on February 21st of a given year, he will designate one group of sows as Group 1. This group will be identified by a certain color. A trapezoidal shaped film 51 of the color selected for the group will be adhered to the disc 15 with the right hand edge of the trapezoidal member aligned with the line 35 indicating the twenty-first day of February. The larger end edge 55 of the trapezoidal film 51 extends through an arc equal to a period of seven days on the circular scale 33 so that the larger end edge 51 of the trapezoidal shaped film 51 which is adhered to the disc 15 will overly a seven day period.

The disc 15 is then rotated until the right hand side of the border 59 of the trapezoidal shaped film 51 aligns with the alignment indicator 47 located at the top of the base 13. The trapezoidal section on the member 51 which is identified by the word "GROUP" receives the numeral 1 indicating group number 1. The grower now knows that it is time that the first group of sows are ready for breeding. Each day the disc 15 is rotated in a clockwise direction so that the numeral indicating the correct day is aligned with the alignment indicator 47. This moves the trapezoidal shaped film 51 in a clockwise direction. When the right hand border 59 of the trapezoidal film 51 is aligned with one of the bands located on the circular scale 25, the grower knows that that group of sows is passing through a significant portion of the breeding and gestation cycles. For example, when the right hand border 59 of the trapezoidal shaped film 51 is aligned with a portion of the band 71, the grower knows that that group of sows are in their breeding stage. When the right hand border 59 of the film 51 reaches the band 73, the grower knows that it is time to check the sows to determine which have returned to heat and thus have not become pregnant. These sows should be recycled or returned to a later group for re-breeding. Experience has indicated that 80% of the sows in a group will become pregnant during the first breeding cycle.

The statistical information as to each group can be recorded on the trapezoidal section 61 of the trapezoidal shaped film 51 for that group. For example, in the portion entitled "BREEDING" the number of sows in the group can be entered for example 20. In the portion designated "GESTATION" the number that become pregnant can be indicated. Assuming that 80% become pregnant, the number 16 would be entered in the portion entitled "GESTATION".

As the disc 15 is moved in a clockwise direction each day, the right hand border 59 of the film 51 for the first group will align with band 75 entitled "PREGNANCY CHECK". Conventionally, sows are checked ultrasonically to determine pregnancy. This number is entered in the segment 63 of the trapezoidal film 51 under the portion designated "GESTATION". Sows that are determined to be pregnant are moved from the breeding house to a gestation building to free the breeding house for later groups of sows. To indicate to the grower when the pregnant sows should be removed from the gestation building and brought to the farrowing house, a sticker 83 designated "To Farrowing" may be applied to the scale 25. In this embodiment of the invention, the sticker is applied to the line 27 indicating the 108th day after the start of the breeding cycle. This date is discretionary with the grower and thus it is indicated by a sticker rather than by a band affixed to the circular scale.

When the trapezoidal shaped film 51 indicates identifying group number 1 of sows reaches the band 77 indicating farrowing time, the grower knows that the sows are ready to deliver and should be located in the farrowing house by this time. A sticker 83 indicating weaned may be applied to a circular scale 25 at a selected line depending on the weaning periods selected. In this example, the sticker 83 is applied to the line 27 indicating the 144th day after the start of the breeding cycle for the sows of group number 1. After the weaning date, the sows of this group become in effect, group 22 and return to the breeding cycle. The member 51 for this group, however, remain on the disc until it reaches a market range. As soon as the pigs of this group are sent to market, the member 51 is removed from the disc.

As each additional group of sows starts the breeding cycle, a distinctive color trapezoidal shaped film 51 for that group is applied to the disc 15 with the right edge border 59 thereof aligned on the date on the circular scale 33 that the group starts the breeding cycle. Although twenty-one separate groups of sows are provided, usually only approximately six colors of trapezoidal films 51 are provided with the colors being repeated. However, each group is separately numbered.

The visual display calculator 11 of this invention enables the grower to visually follow each group of sows and determine when each is to be bred, farrowed and the piglets are ready for market. Additionally, by rotating the dial 15, the grower can determine at what date in the future these various conditions will exist. Thus, the grower has a continuous up-to-date record of the progress of his planned production program.

The visual display calculator 11 is shown in its position on the 4th of April as the seventh group of sows is ready to start the breeding cycle. The film 51 for this group would be the same color as the film for group 1, however, it would be numbered 7 in the space of the film marked "Group". The calculator indicates at a glance that the first group of sows has finished the breeding cycle and by this time should have been removed from the breeding housing.

By way of illustration, an additional film 51 is shown adhered to the display calculator 11 in the position that it would be when the group of pigs which it represents are matured to the point where they are ready to be marketed. Since the films 51 are customarily removed from the display calculator 11 when the group of pigs indicated by it is sent to market, the film 51 shown on the calculator aligned with the band labeled "MARKET RANGE" could be considered representative of the output of the last of a previous sequence of groups of sows which have been bred and the pigs obtained therefrom sold in the market.

We claim:

1. A calculator for use in planning the orderly production of swine throughout a calendar year including:

a base, a disc rotatably mounted on said base about its center, a circular scale formed on said base around the outer edge of said disc, said circular scale having 365 equally spaced marks numbered in sequence around the scale, a circular scale formed at the outer edge of said disc and having indicia indicating the months of the year with each month having indicia indicating the days of the month, the sequence of the indicia on the disc scale running in the opposite direction of rotation to the sequence of indicia of the base scale, an alignment indicator overlying said scales and aligned with the indicia number 1 on the base scale, a series of spaced, circumferentially extending bands superimposed on the indicia of said base scale with the location of each band on the base scale and its arcuate extent corresponding to a time period in the breeding and growing cycle of swine which is significant for production purposes, a series of trapezoidal shaped films releasably adhereable to said disc and adapted to be positioned with the longer end edges of the trapezoidal films located adjacent the peripheral edge of the disc and the tips of the trapezoidal films extending towards the center of the disc, each trapezoidal shaped film having a longer end edge with a length equal to the spacing of seven indicia of the scale on said disc, a transparent portion located at the longer end edge of the trapezoidal film with the remainder of the trapezoidal film being subdivided into information receiving segments.

2. The calculator of claim 1 in which the indicia spacing of the circular scale of the base is identical to the indicia spacing of the circular scale of the disc.

3. The calculator of claim 1 in which said trapezoidal films are made in a series of easily distinguishable colors.

* * * * *